United States Patent [19]

Peiffer

[11] Patent Number: 4,619,571

[45] Date of Patent: Oct. 28, 1986

[54] INSTALLATION FOR THE DISTRIBUTION OF SHEETS

[75] Inventor: Joseph Peiffer, Iden-Pier, Fed. Rep. of Germany

[73] Assignee: O. Dorries GmbH, Duren, Fed. Rep. of Germany

[21] Appl. No.: 366,530

[22] Filed: Apr. 8, 1982

[30] Foreign Application Priority Data

Apr. 22, 1981 [DE] Fed. Rep. of Germany ..... 3115925

[51] Int. Cl.[4] ..... B65H 5/24

[52] U.S. Cl. ..... 414/130; 271/35; 414/115

[58] Field of Search ..... 271/3.1, 35, 186; 414/86, 91, 130, 115, 126, 125

[56] References Cited

U.S. PATENT DOCUMENTS

| | | | |
|---|---|---|---|
| 3,194,127 | 7/1965 | Larsson | 414/43 X |
| 3,262,697 | 7/1966 | Krinke | 271/35 X |
| 3,744,649 | 7/1973 | Ward, Jr. | 271/3.1 X |
| 3,752,043 | 8/1973 | Rapparlie et al. | 419/91 X |
| 3,907,278 | 9/1975 | Jaton | 271/35 X |
| 3,984,659 | 10/1976 | Bilbrey | 271/35 X |
| 4,062,532 | 12/1977 | Peter et al. | 271/35 X |
| 4,081,181 | 3/1978 | Crowe et al. | 271/3.1 |

FOREIGN PATENT DOCUMENTS

| | | | |
|---|---|---|---|
| 2401530 | 7/1975 | Fed. Rep. of Germany . | |
| 2535123 | 3/1976 | Fed. Rep. of Germany . | |
| 2609879 | 11/1977 | Fed. Rep. of Germany . | |
| 1367832 | 9/1974 | United Kingdom . | |
| 1406251 | 9/1975 | United Kingdom | 271/186 |
| 1501375 | 2/1978 | United Kingdom . | |
| 1512367 | 6/1978 | United Kingdom . | |
| 1522266 | 8/1978 | United Kingdom . | |
| 2043035 | 10/1980 | United Kingdom . | |

*Primary Examiner*—Leslie J. Paperner
*Assistant Examiner*—Janice Krizek
*Attorney, Agent, or Firm*—Albert L. Jeffers; Stephen T. Belsheim

[57] ABSTRACT

A method for the distribution of sheets, especially glued together sheets of paper, cardboard, corrugated cardboard and the like, from individual small sheet stacks. The method provides for alternating ones of small sheet stacks proceeding from a machine to be turned over one hundred and eighty degrees and returned to a conveyor belt. Thereafter, individual sheets of sequentially arriving small sheet stacks are delivered to a final loading station. The installation for performing the method comprises an endless conveyor belt having an endless loop formed in its top portion by three deflection rollers disposed between the front and rear guide rollers of the conveyor belt, one of the deflection rollers protruding upwardly through the feed plane of the conveyor belt. At the end of the conveyor belt a back-up rail is disposed thereabove to form an outlet slot therebetween, the width of which slot is controllable to provide stacking of individual sheets at the final station.

2 Claims, 3 Drawing Figures

INSTALLATION FOR THE DISTRIBUTION OF SHEETS

BACKGROUND OF THE INVENTION

The present invention relates to a method and installation for distributing sheets, especially glued together sheets such as paper, cardboard, corrugated paper and the like, where small sheet piles are formed and, after a predetermined number of small sheet piles, a specific number of small sheet piles is turned over back-to-front in a turning station for stacking of individual sheets at a final station.

Particularly with sheets which have been glued together, and which thus consist of different layers, it generally must be borne in mind that the sheets are internally stressed and therefore may buckle due to different initial levels of moisture. With a given combination of materials, the buckling always occurs toward the same side, and when the sheets are laid down in a pile the buckling becomes increasingly noticeable as the height of the pile increases. Mutual adaptations of the levels of moisture of the individual materials can be achieved before they are glued together only with considerable technical outlay and with relatively high energy consumption, both of which are costly. In prior art apparatuses, the glued sheets are gathered together in small piles which are then piled on top of each other so that every second pile is turned back-to-front. In this way the buckled sheets are flattened by the inherent weight of the sheets lying on top of them. When the gluing process has been completed, there then remains virtually no significant buckling.

It is known to perform the turning over of every second small pile by hand or mechanically, and to stack the small piles on a pallet to form a large pile. Turning over by hand is exacting work and the cost for doing so are high. Further, considerable disadvantages also exist in mechanically turning over the piles; namely, it is difficult to push the small piles which are still relatively heavy onto the final pile and to stack them in precise alignment. The technical outlay to perform this is considerable and, in addition, displacement may occur within the small piles during turning and transportation, which cannot be remedied later without considerable technical outlay.

Attempts have been made to solve the problem by distributing the sheets alternately by using two feeders on two sides, having previously turned the sheets of one of the feeders. However, such apparatuses are extremely expensive to build, and take up a great deal of space. Consequently, it is not possible to produce a coherent, compact plant from production machinery to the final stacking station. Further, since the times which elapse between production and the alternate turning over are relatively long, the buckling of the sheets has already been "frozen in" to a large extent and may no longer be remedied.

The present invention provides a method and an installation for carrying out the method by means of which it is possible to achieve, even in high output plants, substantially trouble free distribution of sheets already stacked in small piles, with the desired alternation of turned and unturned small piles, and which also may be used to establish a coherent, compact plant from production machinery to the final stacking station.

The present invention solves the above problem by providing a method wherein, between the turning station and final stacking station, the small sheet piles are arranged in a line of staggering, overlapping sheets, which is then subsequently delivered to the final stacking station, for example, a layboy. Preferably, the overlapping and staggering of individual sheets are effected from individual small sheet piles by moving the bottommost sheet in turn on the conveyor belt.

The method of the present invention makes possible the fully automatic, flawless stacking of the sheets in the desired alternating fashion which counteracts the buckling of the sheets, even in high output plants.

In a preferred embodiment for performing the method, according to the present invention, there is a device for staggering and overlapping sheets by means of an endless conveyor belt which acts on a pile from below and cooperates with a backup rail. The upper section of the conveyor belt, which is guided over a front guide roller and a rear guide roller, is passed back over a first deflection roller serving as a feed roller to form a conveyor belt loop out of the conveying plane and down over second and third deflection rollers into the original conveying direction again. Between the first and third deflection rollers, there is a slot which can be bridged by a sheet, and the upper surface of the feed roller projects beyond a tangential plane disposed on the surface of the rear guide roller and the surface of the third deflection roller. The backup rail is arranged in the conveying direction a predetermined distance from the loop in the conveyor belt. Preferably, the outlet slot formed between the backup rail and the conveyor belt is adjustable.

Such an installation according to the present invention could be arranged in a corrugated cardboard laminating machine adjoining a sheet collecting station and a turnover machine following it. In the sheet collecting station, the sheets which, after leaving the laminating machine, have been severed in a separating device and undergone a first sheet staggering and overlapping process, are gathered into small piles. Every second one of these small piles is turned over by the turnover device. All of the small piles are then staggered and overlapped again into a line of staggering and overlapping sheets so that individual sheets are supplied for stacking at the final station. In a known manner, side and end vibrators may be provided to push each top sheet into the correct position so that a smooth, aligned final pile is obtained. Accordingly, an ordinary layboy may be used.

According to an advantageous feature of the present invention, the installation is adaptable to different sheet format lengths. The deflection rollers for the upper section of the conveyor belt may be mounted in a longitudinally adjustable carriage, thereby making it possible to set the conveyor belt loop at the optimum distance from the backup rail for the format length involved in each particular case.

Another advantageous feature of the present invention permits variation in the size of the outlet slot formed between the conveyor belt and the backup rail, which is pivotable about an axis extending parallel to the conveyor belt and transverse to the conveying direction. Thus, control of the size of the opening of the outlet slot is simply accomplished, and is preferably effected by means of a cam disc that is preferably driven from the conveyor belt drive and engaged by a clutch. Another aspect of the invention permits the clutch to be released or tripped by a pulse transmitter having no contacts, for example, a photoelectric cell, which can be controlled by a small pile approaching the backup rail. In the basic position, the outlet slot is closed. The approach of a small pile is registered by the photoelectric cell and relayed to a control which starts the drive of a cam disc. By the time the bottom sheet has reached the backup rail, the outlet slot has been opened by an amount corresponding to the thickness of a sheet allowing the lowermost sheet to pass therethrough without impediment, while topmost sheets are held back by the backup rail. When this occurs, the small pile is essentially supported by a supporting table, which is disposed underneath the conveyor belt in the region of the backup rail, and by the feed roller. The feeding force for the bottom sheet is produced by the difference between the static friction of the sheet on the conveyor belt and the static friction between the sheets, the latter being substantially less. After the bottommost sheet has run forward a specified distance, the next sheet is pressed onto the feed roller and experiences a feeding force increased by the sliding friction between the sheet and the conveyor belt with half the weight of the pile. Meanwhile, the outlet slot has been increased by a further sheet thickness so that the second sheet may pass therethrough.

Since the cam disc is driven by the conveyor belt drive, the overlapping and staggering of sheets is fixed and dependent upon specific sheet thicknesses, irrespective of the format length of the sheets. This fixed amount of overlapping and staggering can be varied by changing the transmission ratio of the drive.

When the trailing edge of the first or bottommost sheet has passed the backup rail, the outlet slot is not enlarged again. This is accomplished in accordance with the invention by providing a time relay which can control the maximum opening of the outlet slot. The time relay may also switch the drive off. Everytime a trailing edge of the sheet passes through the outlet slot, the leading edge of the following sheet is urged on by the weight resting on top of it. The overlapping and staggering of sheets is maintained without the outlet slot being enlarged any further. When the last sheet has passed through the outlet slot, this is reported by the photoelectric cell to the control and the backup rail moves back into its basic position to close the outlet slot.

It is an object of the present invention to provide an improved method for the distribution of sheets, especially glued together sheets such as paper, cardboard, corrugated cardboard and the like.

Another object of the present invention is to provide an installation for performing the method.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
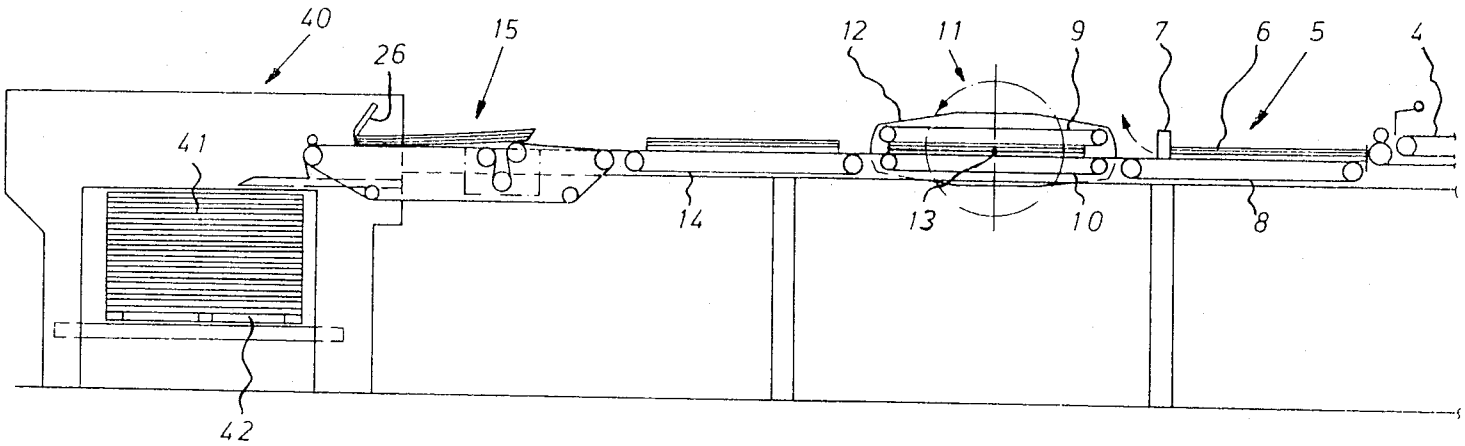
FIG. 1 is a side elevational view, drawn schematically, showing a laminating machine having at its end a sheet collecting station, which is followed by a turnover device and a second sheet-by-sheet distribution device.

The sheets arriving from a corrugated paper laminating machine (not shown), an example of which may be found in West German Pat. No. 2,748,675, are fed sheet by overlapping sheet onto a relatively slow conveyor belt 4 and are laid down in small pile 6 at a sheet gathering station 5. Once a small pile 6 is formed, backup rail 7 opens and small pile 6 is fed by belt 8 between belts 9 and 10 of turnover device 11. Every second small pile 6 is turned through 180° by rotation of side parts 12 carrying belts 9 and 10. The drive for rotating turnover device 11 has not been shown. While being turned, small pile 6 is prevented from sliding out between belts 9 and 10 by stop rails (not shown). From turnover device 11, a small pile 6 reaches holding belt 14 and is then delivered to second sheet-by-sheet distribution device 15.

Figure 2:
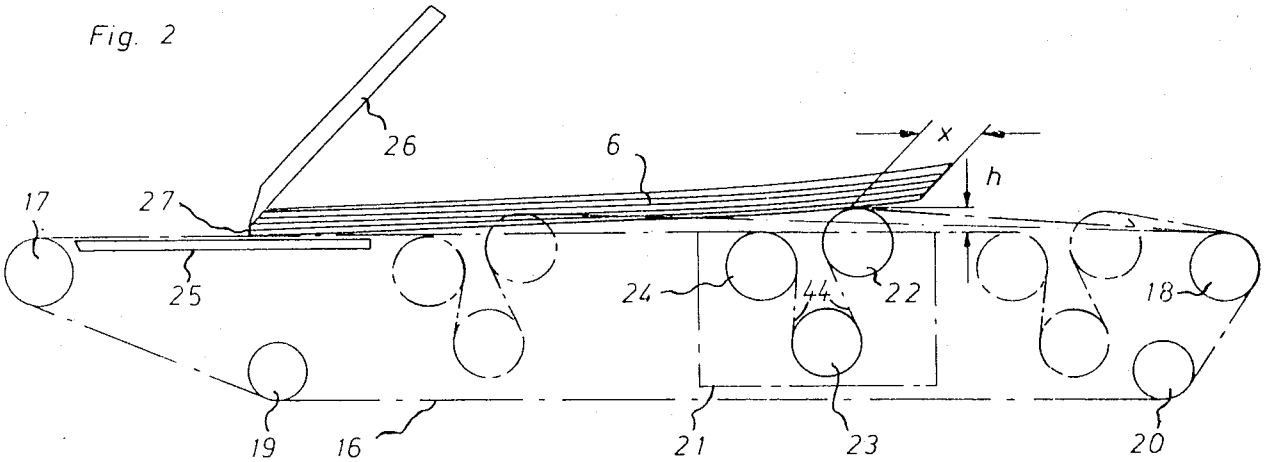
FIG. 2 is an enlarged side elevational view of the second sheet-by-sheet distribution device of the present invention.
Figure 3:
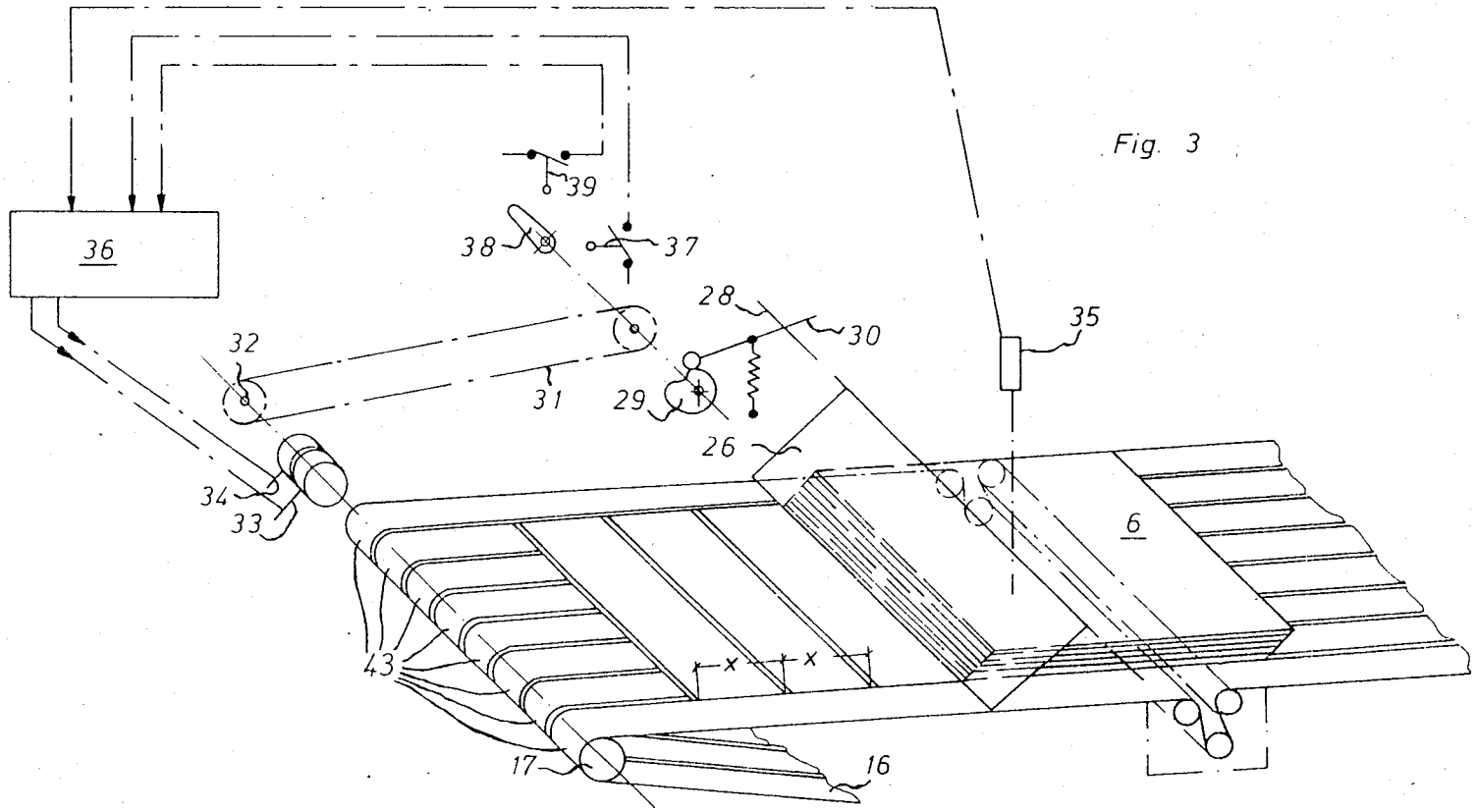
FIG. 3 is a partial perspective view of FIG. 2 with a control scheme therefor.

Referring now to FIGS. 2 and 3, distribution device 15 comprises conveyor belt 16, which comprises a plurality of adjacently disposed partial belts 43, and wherein conveyor belt 16 is guided across front guide roller 17 and rear guide roller 18, as well as over lower guide rollers 19, 20. Carriage 21, which has been shown schematically in FIGS. 1 and 2, supports first deflection roller 22, which serves as a feed roller, and two additional deflection rollers 23, 24. Conveyor belt loop 44 is formed by conveyor belt 16 passing over deflection rollers 22, 23, 24 and protrudes downwardly as illustrated in FIG. 2. Further, loop 44 may be moved to a left position, shown in dotted lines, or to a right position, shown in dotted lines, or other positions therebetween. First deflection roller or feed roller 22 protrudes beyond the upper tangential plane of rollers 18, 24 by a distance h so that a small pile 6, with the interposition of conveyor belt 16, comes to rest partially upon feed roller 22 and partially upon supporting table 25, which is located in the region of backup rail 26. Backup rail 26 is disposed at an acute angle with respect to conveyor belt 16 and forms therewith outlet slot 27. Viewing FIG. 3, backup rail 26 is arranged such that it may pivot about axis 28, which pivoting is provided by cam disc 29 acting on lever 30, which is drawn schematically only. Cam disc 29 is driven by a V-belt drive 31 and front guide roller 17, which is continuously driven by the basic machine unit (not shown). V-belt drive 31 has magnetic clutch 33 and brake 34 disposed between roller 17 and driving pulley 32. Photoelectric cell 35, which is disposed above backup rail 26 and a small distance from outlet slot 27, operates under a conventional control device 36 to release clutch 33 to thereby release cam disc 29 just before a small pile 6 arrives at backup rail 26. Backup rail 26, which in its base position closes outlet slot 27, pivots upwardly until slot 27 is large enough for the bottom sheet to be carried along due to the static friction between the sheet and conveyor belt 16, which friction is especially great in the region of feed roller 22 and supporting table 25. The static friction between conveyor belt 16 and the lower most sheet is greater than the friction existing between individual sheets. When the lower most sheet has moved forward a distance x, the next sheet reaches the region of feed roller 22 where the sheet will come to rest upon conveyor belt 16 to be carried therealong. Meanwhile, outlet slot 27 has widened to a thickness of two sheets.

The control system is designed so that when a whole length of a sheet has passed by backup rail 26, clutch 33 is disengaged and further driving of cam disc 29 is interrupted. Cam disc 29 is driven at a constant speed which is dependent upon the speed of conveyor belt 16. Thus, a constant or predetermined distance of staggering and overlapping, x, is obtained during the sheet-by-sheet distribution. If the transmission ratio of drive 31 is changed, for example, to a faster speed, then length x will become shorter. The control of the automatic switch off of cam disc 29 may occur by aid of a time relay (not shown) which has been placed in control device 36. Alternately, the time relay may be replaced by an electronic control which will be governed by the length of the format and by the feed velocity. Once the last sheet of a small pile 6 has run out, photoelectric cell 35 registers such to control device 36, and backup rail 26 returns to its base position, thereby closing outlet slot 27.

Should the time relay be erroneously set to an incorrect preselected time duration, main switch 37 prevents outlet slot 27 from opening greater than a maximum width, thereby preventing backup rail 26 from exceeding its maximum opening. Cam 38 actuates switch 37, and also actuates switch 39 which is closed when the last sheet of small pile 6 has left photoelectric cell 35 exposed and an appropriate command for switching on drive 31 has been relayed by control 36. By closing switch 39, backup rail 26 returns to the base position and outlet slot 27 is closed.

The sheets which have been staggered and overlapped in distribution device 15 are subsequently stacked by conventional means inside layboy 40 to form large pile 41 upon pallet 42.

While this invention has been described as having a specific embodiment, it will be understood that it is capable of further modifications. This application is therefore intended to cover any variations, uses or adaptations of the invention following the general principles thereof, and including such departures from the present disclosure as come within known or customary practice in the art to which this invention pertains and fall within the limits of the appended claims.

What is claimed is:

1. In an installation for laying down sheets, particularly sheets of paper, cardboard, or corrugated cardboard, including means for forming small piles of the sheets which are finally laid down in a large pile in a final laying down station, and means for turning a specific number of the small piles front-to-back after a predetermined number of sheets form a small pile, an apparatus for converting the small piles into a line of staggered overlapping sheets that is supplied to the final station, comprising:

conveyor means between said turning means and final laying down station for pulling away each bottom sheet in turn from the snall pile being converted, means disposed above said conveyor means for spacing adjacent pulled away sheets of the small piles a predetermined distance apart, said conveyor means including front and rear guide rollers and a conveyor belt disposed therearound, a first deflection roller being disposed between said front and rear guide rollers, a second deflection roller having at least a portion thereof disposed between said first deflection roller and said front guide roller, said second deflection roller being disposed downwardly relative to said first deflection roller, a third deflection roller having at least a portion thereof disposed between said second deflection roller and said front quide roller, said first deflection roller having a top surface portion thereof extending upwardly a certain distance beyond a plant disposed on respective top surface portions of said rear guide roller and said third deflection roller, said deflection rollers being located inside a longitudinally adjustable carriage so as to be adaptable to sheets of varying length, said conveyor belt having a top portion thereof disposed over at least a top surface portion of said first deflection roller and over at least a bottom surface portion of said second deflection roller and over at least a top portion of said third deflection roller, whereby a top portion of said conveyor belt is formed as a loop that moves downwardly out of the feeding plane of said conveyor belt and then returns upwardly into the feeding plane of said conveyor belt, thereby forming a slot between said first and third deflection rollers that is bridgeable by a sheet, said spacing means includes a backup rail disposed in the feed direction a predetermined distance from said loop of said conveyor belt, and said backup rail having a bottom edge wherein said bottom edge and said conveyor belt define therebetween an outlet slot, said backup rail being movable during operation of the installation under the action of a cam disc so that said outlet slot is adjustable during the operation of the installation from a base position in which the outlet slot is closed so as to be less than the thickness of one sheet, the maximum opening of the slot is controllable by an adjustable time relay, said cam disc is operated by a drive device operatively connected to the drive of said conveyor belt and engageable therewith by a clutch, said drive device for said cam disc has an adjustable transmission ratio.

2. The installation of claim 1 wherein the release of said clutch occurs by a non-contact pulse transmitter which will become released by a small pile of sheets approaching said backup rail.

* * * * *

UNITED STATES PATENT AND TRADEMARK OFFICE

CERTIFICATE OF CORRECTION

PATENT NO. : 4,619,571

DATED : October 28, 1986

INVENTOR(S) : Joseph Peiffer

It is certified that error appears in the above-identified patent and that said Letters Patent is hereby corrected as shown below:

Claim 1, Col. 6, line 18, change "plant" to --plane--.

Signed and Sealed this

Thirty-first Day of March, 1987

*Attest:*

DONALD J. QUIGG

*Attesting Officer*

*Commissioner of Patents and Trademarks*